US007144013B2

(12) United States Patent
Tanaka

(10) Patent No.: US 7,144,013 B2
(45) Date of Patent: Dec. 5, 2006

(54) CARD GAME

(75) Inventor: Tokio Tanaka, Saitama (JP)

(73) Assignee: Konami Corporation, Tokyo (JP)

( * ) Notice: Subject to any disclaimer, the term of this patent is extended or adjusted under 35 U.S.C. 154(b) by 0 days.

(21) Appl. No.: 10/645,294

(22) Filed: Aug. 21, 2003

(65) Prior Publication Data

US 2004/0036220 A1 Feb. 26, 2004

(30) Foreign Application Priority Data

Aug. 21, 2002 (JP) ..... 2002-241245

(51) Int. Cl.
*A63F 1/00* (2006.01)

(52) U.S. Cl. ..... 273/308; 273/302; 273/292; D21/384; D21/383; D21/376

(58) Field of Classification Search ..... 273/250–299, 273/300–349; D21/376, 383, 384
See application file for complete search history.

(56) References Cited

U.S. PATENT DOCUMENTS

| | | | | |
|---|---|---|---|---|
| 5,662,332 | A | 9/1997 | Garfield | |
| 6,254,099 | B1 | 7/2001 | Pederson | |
| 6,322,077 | B1 | 11/2001 | Braunlich et al. | |
| 6,435,508 | B1 | 8/2002 | Tavel | |
| RE37,957 | E | 1/2003 | Garfield | |
| 6,554,702 | B1 | 4/2003 | Mahar et al. | |
| 2002/0040929 | A1 * | 4/2002 | Bramucci | 235/435 |
| 2002/0043764 | A1 * | 4/2002 | Imhof | 273/292 |

FOREIGN PATENT DOCUMENTS

| | | |
|---|---|---|
| JP | 2001-058020 | 6/2001 |
| JP | 2001-204874 | 7/2001 |
| JP | 2002-058780 | 2/2002 |

* cited by examiner

*Primary Examiner*—Benjamin Layno
(74) *Attorney, Agent, or Firm*—Rankin, Hill, Porter & Clark LLP

(57) ABSTRACT

Provided herein is a card game involving two or more players that is intended to readily increase overall attack power and allows the players to get familiar with the game in a relatively short time and the game to be completed also in a relatively short time. The game is played by using the character (battle) cards. On the character (battle) card C16, an additional attack power indicator 27 is provided in addition to an attack power indicator 25. Also, on the playing face of the effect indication card is provided an indicator for additional attack power. During his or her turn, the player pays cost by turning the bomb (cost payment) card B. The player draws one card C16 from his or her deck and places it face up on the play field. Then, the player uses the additional attack power of the card C16 to deliver attack on the opposing player's character card C56 which the player has selected as a target, and inflicts damage on that target. The player whose predetermined points are reduced down to zero will lose the game.

5 Claims, 14 Drawing Sheets

CARD GAME

BACKGROUND OF THE INVENTION

The present invention pertains to a card game, and more particularly, to a card game involving two or more players, each of whom uses his or her deck comprised of a plurality of cards.

In some of conventional card games involving two or more players, the winner is determined by offsetting the attack power and defense power indicated on battle cards which have been placed on a play field by one of the players against the attack power and defense power indicated on battle cards which have been placed on the play field by other players. In addition, a plurality of effect indication cards to be brought into play when used are included in a deck of cards for each player. During a turn (for attack) of each player, the effect indicated on such effect indication card is brought into play by fulfilling cost payment or paying required cost. Thus, a battle or game using battle cards is made more effective or interesting. For example, some effect indicated on the effect indication card modifies the attack power or defense power of the battle cards.

Only with the use of the effect indication cards, however, the game cannot be proceeded with smoothly unless the players are familiar with the types of the effect indication cards and how respective effects work. It takes a lot of time until beginner players become familiar with the game. In conventional card games, there is some limitation to voluntarily advance the development of the game by the players and it tends to take comparatively a lot of time to complete one game.

SUMMARY OF THE INVENTION

The present invention has been made in view of the foregoing disadvantage of the prior art.

It is therefore an object of the present invention to provide a card game which allows players to readily increase overall attack power and to get familiar with the game in a relatively short time.

It is another object of the present invention to provide a card game which allows for shortened play time of one game by effectively constructing strategy.

It is still another object of the present invention to provide a card game for which the balance of attack power with additional power can optionally be predefined.

It is yet another object of the present invention to provide a card game in which players themselves can be a target of attack.

It is a further object of the present invention to provide a card game which allows for easy recognition of cost payment conditions and for simple definition of difficulty of cost payment conditions.

It is another object of the present invention to provide a card game which allows each player to obtain additional attack power at any time as far as the player is able to fulfill cost payment.

A card game according to the present invention involves two or more players, each of whom uses his or her own deck of a plurality of cards. Each player may construct his or her own deck of the plurality of cards, for example, by selecting from a reservoir or pool of a plurality of cards that the player has already owned. The cards which each player uses include a plurality of battle cards having at least attack power and defense power indicated thereon, a plurality of effect indication cards having effect indicated thereon which is brought into play when used, and a plurality of cost payment cards to be used for cost payment. The attack power and defense power may be indicated independently of each other on the battle card. If they are the same, they may certainly be indicated on the card with a single symbol representing both of the attack and defense powers. In the present invention, the battle cards and/or the effect indication cards, namely at least either of the battle cards or effect indication cards, have an indication of additional attack power thereon that is executed provided that the cost payment is fulfilled. The additional attack power may be zero in some occasions. With this arrangement, cost payment is wasted in some cases, thereby allowing more room for chance and luck in the game development.

According to the present invention, the player can play a game against other players by executing additional attack power indicated on one or more battle cards and/or one or more effect indication cards of the player's hand of cards or deck of cards or those cards placed on the play field, provided that the cost is paid using the cost payment card. Thus, the battle cards and effect indication cards can be used not only as originally designed to take specific effect, but also to bring the additional attack power into play. The overall attack power of the player can be increased without using the effect indicated on the effect indication card. Therefore, the player can become familiar with the game in a relatively short time even if he or she does not know how the effect indicated on the effect indication card works. By strategically determining at what stage of the game and how much additional attack power should be executed, the game can be completed in a short time. Such strategy building leads to increased overall attack power comprising attack power plus additional attack power or accumulated additional attack power.

Especially, additional attack power can optionally be defined for the battle cards regardless of their attack power by assigning additional attack power to the battle cards in addition to their attack power. Accordingly, how far and how much the influence or effect of the additional attack power extends can be defined by properly establishing the balance of the attack power with the additional attack power. Therefore, the present invention can provide a card game which can properly define the balance of the attack power with the additional attack power according to the age of the players or how much the players are familiar with the game. Thus, a card game according to the present invention can readily be adapted to the players of any level of skill.

One of the winning conditions may be to reduce an opposing player's points down to zero on an assumption that each of the players is allocated a predetermined value of points. In this case, it is preferred to allow the player to choose to direct the attack power and additional attack power to one or more battle cards placed on the play field of the opposing players or to directly reduce the predetermined points of the opposing players. With this, the player can not only elaborate a strategy of positively reducing the points of the opposing players, but also become more interested in the game since he or she has to work out a defensive strategy against such attack by the opposing players.

Each of the cost payment cards may have a symbol thereon indicating that each card belongs to one of a plurality of category groups. The battle cards may have one or more symbols thereon indicating cost required to place the card on the play field or to enter the card into play. With these indications, cost payment conditions can readily be recognized, thereby allowing the players to proceed with the game smoothly. In addition, since it is possible to easily define how difficult respective cost payment conditions are, the level of difficulty of game play can also be easily established according to the age of the players or how much the players are familiar with the game.

When the player, has his or her hand of cards or deck of the cards, the only attack power available for use in a battle may be that of the battle card which is drawn from his or her hand and placed on the play field by fulfilling the cost payment. And, the only additional attack power available for use in the battle may be those of one or more cards which are drawn from his or her deck by fulfilling the cost payment. With these rules of play, how much and when additional attack power can be obtained depends upon the category group of each card in the deck and its position in the deck. Accordingly, unpredicted development of the game can be expected, thereby increasing the player's interest in the game.

The cost payment card may have a description thereon indicating effect to be brought into play, accompanying an execution of the additional attack power by fulfilling the cost payment. Thus, the additional attack power can be more effective, thereby resulting in more dynamic development of the game.

BRIEF DESCRIPTION OF THE DRAWINGS

The foregoing and other features and advantages of the present invention will become more readily appreciated as the same becomes better understood by reference to the following detailed description when taken into conjunction with the accompanying drawings wherein.

DETAILED DESCRIPTION OF PREFERRED EMBODIMENT

Figure 1:
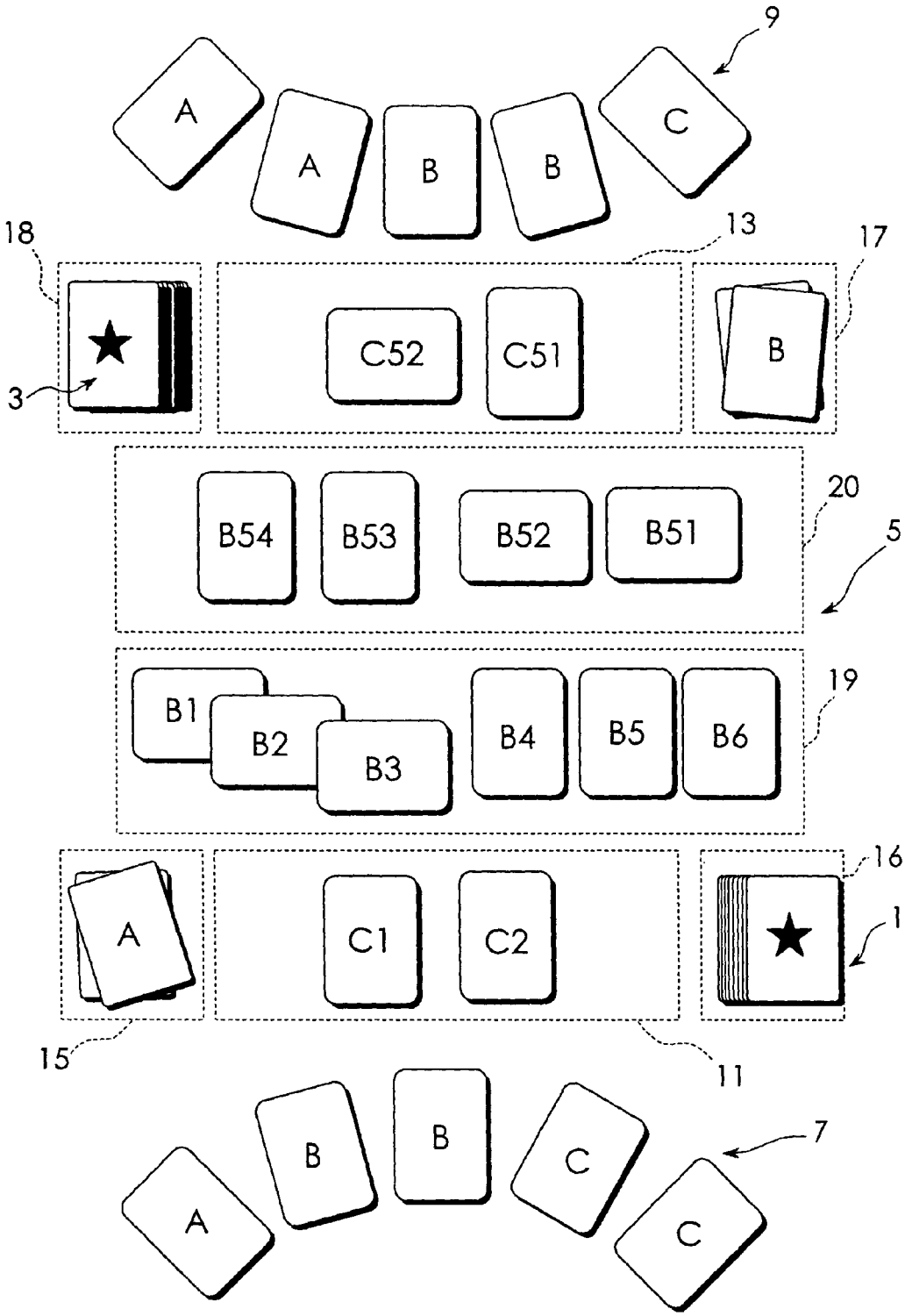
FIG. 1 is a schematic drawing showing how a card game according to the present invention is played by two players.

Referring to the accompanying drawings, a preferred embodiment of the present invention will be hereinafter described in detail. FIG. 1 briefly illustrates an in-play situation of a card game involving two players according to the present invention. A card game according to the present invention may be played by two or more players. Each player may construct his or her own deck of the plurality of cards, for example, by selecting from a reservoir or pool of a plurality of cards that the player has already owned. Two players respectively use decks 1, 3 of a plurality of cards. A play field 5 may be simply composed of a desk surface or floor surface. In this embodiment, the play field is visually indicated by a dotted line on the desk surface. Such play field may be prepared in the form of a sheet. Needless to say, a special sheet is not needed for the card game according to the present invention.

The decks 1, 3 are initially composed of 40 or more cards, The decks 1, 3 include cards which are largely grouped into three categories. These categories are a group of battle cards (C), a group of effect indication cards (A) which are brought into play when used, and a group of cost payment cards (B) to be used for cost payment. In FIG. 1, a group identifier (A, B, C) is shown on the playing face of each card for reference, indicating the category group which the card belongs to. A star symbol ★indicates that it is the back surface.

In FIG. 1, two sets of cards designated with numerals 7 and 9 are respectively the hand for each player. In this embodiment, each player obtains an opening hand of five cards by drawing from his or her deck. At the beginning of a turn of each player, the player draws one card from his or her deck to include the card in his or her hand. In FIG. 1, areas designated with 11 and 13 are a battle card area or a place for battle cards (C). Areas designated with 15 and 17 are respectively a trash into which cards are discarded. Areas designated with 19 and 20 are a cost payment card area or a place for cost payment cards.

Figure 2A:
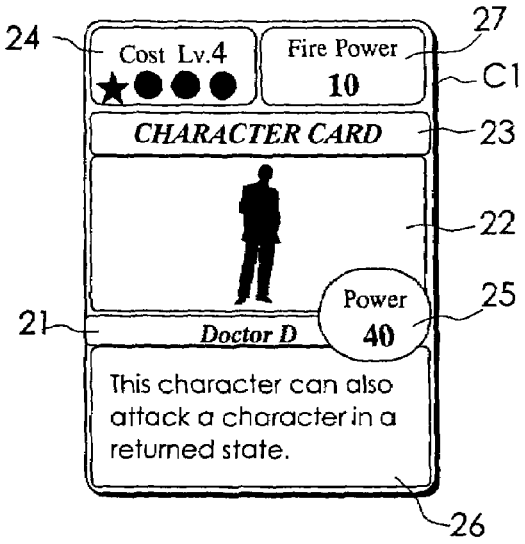
FIGS. 2A, 2B, and 2C are top plan views respectively showing three examples of the character cards placed face up that are used in one embodiment of the present invention.
Figure 2B:
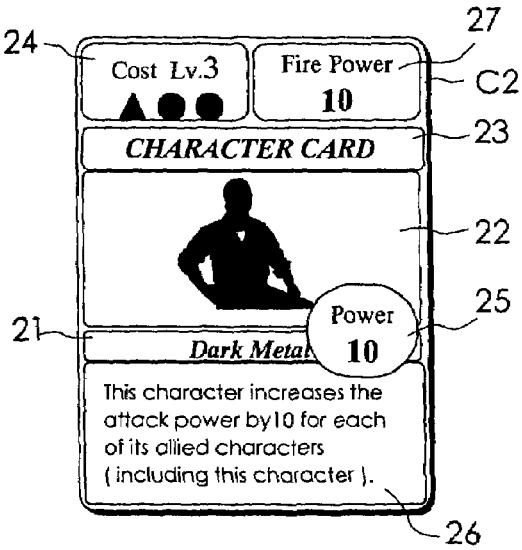
Figure 2C:
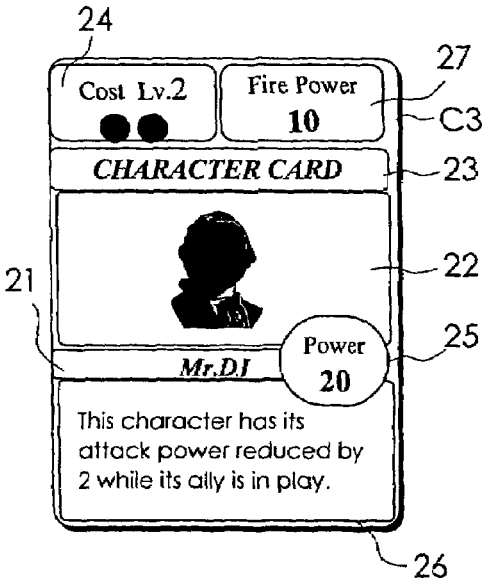

The battle cards (C) have the attack power and defense power (attack and defense power) associated therewith as indicated thereon. The battle cards are mainly used in a battle against the opposing player. In this embodiment, the battle cards are usually called as "Character Card." In th following descriptions, the battle card is often called as character card. FIGS. 2A, 2B and 2C are top plan views respectively showing three character cards C1, C2, C3 face up. These character cards C1, C2, C3 respectively have a name section 21 for indicating the card name, a pictorial section 22 for illustrating the character associated therewith, a group name section 23 for indicating the name of the group to which the card belongs, a cost indicator 24 for indicating with a numeral and symbol the cost required to make the card available for use (for example, the cost required to place the card on the play field), an attack/defense power indicator 25 for indicating with a numeral the attack power (an amount of damage to be inflicted on the opposing player in the game) and the defense power (amount of damage to be absorbed or resisted in an attack from the opposing player) of the card, an effect indication section 26 for indicating the effect to be brought into play when the card is placed on the play field, and an additional attack power indicator 27 for indicating with a numeral the additional attack power (an amount of damage to be inflicted on the opposing player in the game) to be executed by fulfilling the cost payment. In FIGS. 2A, 2B and 2C, since the attack power is equal to the defense power for the card, the power indicator 25 denotes the power for both of attack and defense. If the attack power is different from the defense power for the card, a separate power indicator may be provided each for attack and defense. In this case, both of an attack power indicator and a defense power indicator may be provided.

For example, In FIG. 2A, "Lv.4", the cost indicator 24 denotes that the card costs four (4) to bring the card into play. "★●●●" stands for a cost payment condition. A star symbol "★" denotes one cost payment card associated therewith as described later. Bullet symbols "●●●" denote three cost payment cards associated therewith as described later. Such rule may be defined that the symbol "●" does not specify the type of the cost payment card, namely any type of the cost payment card can be used for payment.

When these character cards C1, C2, C3 are in the player's hand, they can be placed on the play field by paying the cost. These character cards can be used as battle cards by placing the cards face up in the battle card area 11 or 13 on the play field 5 as shown in FIG. 1. As described later, these cards are to be trashed or discarded to the trash if they have got damaged, namely the opposing player's attack power (plus additional attack power) is larger than the player's defense power.

The additional attack power of the character card takes effect in an action which will be described later. The effect of additional attack power of the character card is brought into play when it is drawn from the deck provided that the required cost is paid using the cost payment card B. After the additional attack power is consumed, the card is trashed or discarded to the trash.

For example, the effect indication section of the character card reads as follows:

"Two or more cards of this character may be placed on the play field. When this character card is in the trash, it may be returned to your hand by paying one cost."

"This character has its attack power increased by 10 while X is in play as an ally. On the other hand, while X is in play as an enemy, this character has its attack power reduced by 20."

"This character increases the attack power by 10 for each of its allied characters (including this character)."

"This character can also attack a character in a returned state."

"One or more cards of this character may be placed on the play field. This character has its attack power increased by 20 while it is in a returned state."

"This character has its attack power increased by 20 during your turn."

Figure 3A:
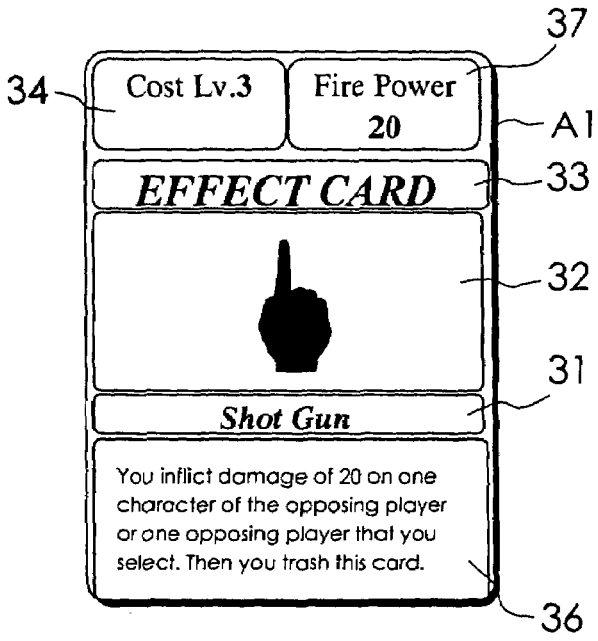
FIGS. 3A and 3B are top plan views respectively showing effect indication card examples face up.
Figure 3B:
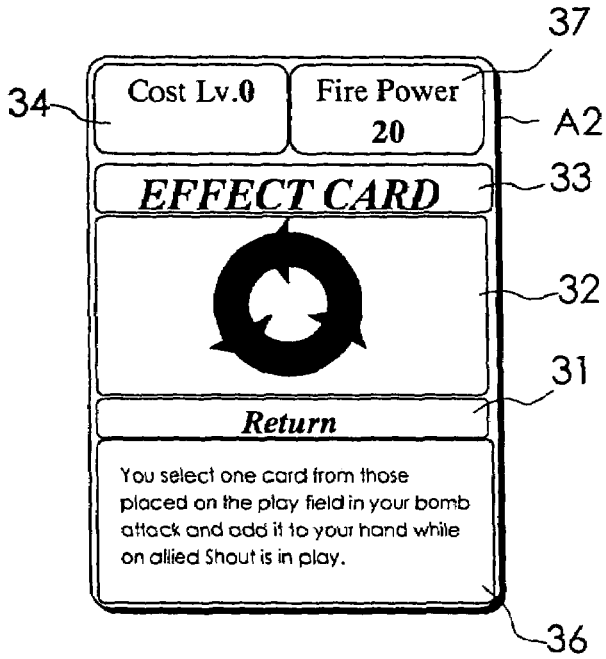

FIGS. 3A and 3B respectively show the playing faces of the cards A1, A2, called as "Effect Card," indicating the effect associated therewith. If the effect indication card is included in the player's hand, the card takes effect only once during one turn of the player. Once the effect has been brought into play, the card is trashed or discarded to the trash. These effect cards A1, A2 respectively have a name section 31 for indicating the card name, a pictorial section 32 for illustrating the character associated therewith, a group name section 33 for indicating the name of the group to which the card belongs, a cost indicator 34 for indicating with a numeral and symbol the cost required to make the card available for use, an effect indication section 36 for indicating with a numeral the effect to be brought into play when available for use, and an additional attack power indicator 37 for indicating with a numeral the additional attack power (an amount of damage to be inflicted on the opposing player in the game) to be executed by fulfilling the cost payment. In an example shown in FIG. 3A, "Lv. 3", the cost indicator 34 indicates that three costs are required to enable the card to take effect. In an example shown in FIG. 3B, the cost indicator 34 reads "Lv. 0" and no symbol is indicated. This means that cost payment is not needed. Therefore, this effect card can be selected from the hand and placed on the play field without paying the cost. In this embodiment, the effect cards are not assigned cost payment conditions, unlike the character cards. In order to enable the effect card to take effect, the cost is paid by using the cost payment cards equivalent to the necessary cost. In other embodiments of the present invention, cost payment conditions may be assigned to the effect indication cards, being indicated with a symbol as is the case with the character cards.

Since, like the character card C, these effect cards A1, A2 have an indication of additional attack power thereon, the cards take effect of additional attack power in an additional attack which will be described later. Then, they are trashed or discarded to the trash after taking effect.

For example, the effect indication card reads as follows:

"You search a bomb card in your deck, and place and turn it on the play field. You shuffle the deck. Then, you trash this card."

"You draw three cards. Then, you trash this card."

"You inflict damage of 20 on one character of the opposing player or one opposing player that you select. Then, you trash this card."

"You inflict damage of 30 on all of the characters of the opposing player. Then, you trash this card."

Figure 4A:
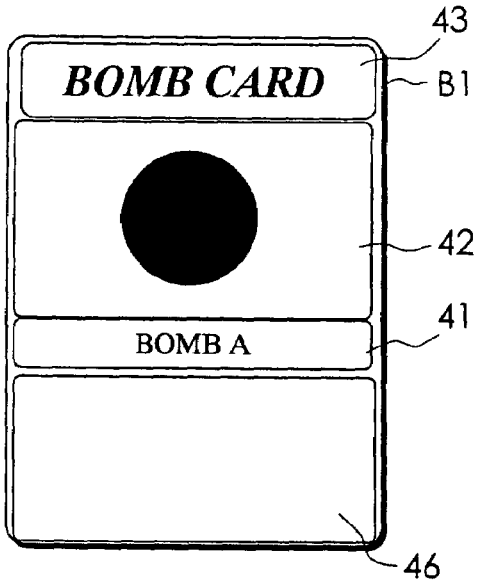
FIGS. 4A, 4B, and 4C are top plan view respectively showing cost payment card examples face up that are used in this embodiment of the present invention.
Figure 4C:
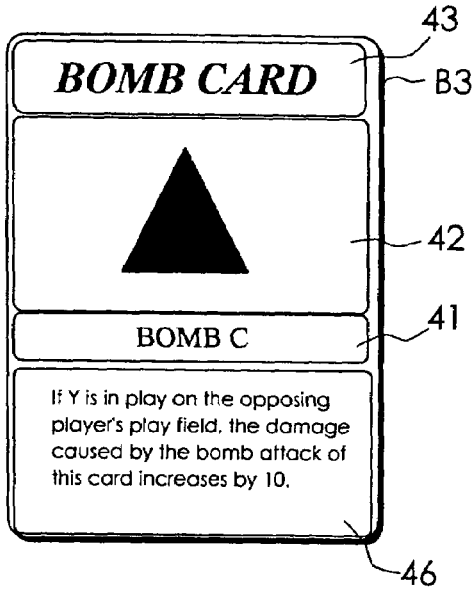
Figure 4B:
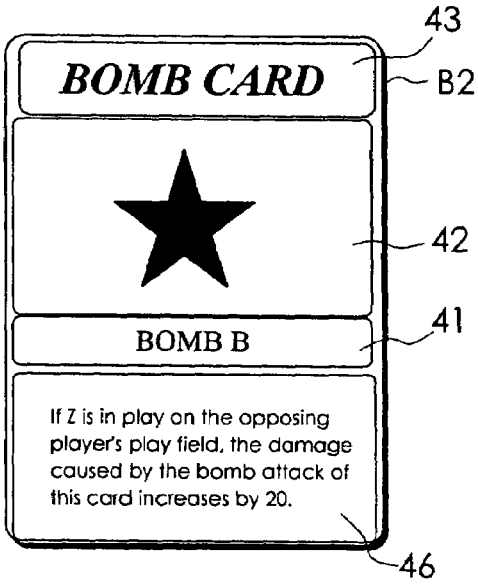

FIGS. 4A, 4B, and 4C are top plan views respectively showing cost payment cards B1, B2, and B3 face up. The cost payment card is used in an action, namely an additional attack or bomb attack, to pay the cost and obtain the additional attack power. In this embodiment, the cost payment card is usually called "Bomb Card." The cost payment card is often called as bomb card in the following descriptions.

The cost payment or bomb cards B1, B2, B3 respectively have a name section 41 for indicating the card name, a group symbol section 42 for indicating with a symbol the group which the card belongs to or illustrating the character associated therewith, a group name section 43 for indicating the name of the group which the card belongs to, and an effect indication section 46 for indicating the effect to be brought into play when the card is used in a bomb attack which will be described later. The symbol used in the group symbol section 42 is the same as the one which is indicated in the cost indicator 24 of the character (battle) card C and the cost indicator 34 of the effect indication card A. Therefore, the player pays the cost by knowing the necessary amount of cost from this symbol. For example, the effect indication section 46 reads as follows.

"If Y is in play on the opposing player's play field, the damage caused by the bomb attack of this card increases by 10."

"If X is in play on the opposing player's play field, the damage caused by the bomb attack of this card increases by 15."

In this embodiment, the player draws one card from his or her deck by paying one cost with this bomb card. If the drawn card has an indication of additional attack power, the player takes an action called bomb attack which brings the effect of additional attack power into play. The bomb attack will be described later in detail.

The preparations for the game and steps of executing a turn will now be described according to this embodiment of the present invention.

[Preparations for the Game]

1) The play order of players participating in the game is determined.

2) The players fully shuffle their decks 1, 3 and place them on their respective deck spots 16, 18. During the game, if there remain no available cards in the deck for the player, the player can re-use as the deck his or her discarded cards in the trash by shuffling and placing them on the deck spot. In order to complete the game in a short time, such rule may be established that the player having no more available cards in his or her deck will be a loser.

3) Each player draws five cards from his or her deck to obtain an opening or initial hand 7, 9. Then the game is initiated. The first player executes his or her turn in clockwise sequences with other players.

4) It is assumed that each player is allocated a predetermined value of points (for example, 200 points). This means that the players themselves can be an attack target.

[Damage Dealing on the Character Card]

In a situation that the character card C is damaged, namely the opposing player's attack power (including the additional attack power) is larger than the player's defense power, the character card C is discarded to the trash of the player.

[Winning Condition]

When the player reduces the points allocated to the opposing player down to zero, the player will win the game. When the number of use for the deck is limited to once, another winning condition may be added that a player having no more available cards in his or her deck will lose the game.

[Phases of the Game (Executing a Turn)]

Figure 5:
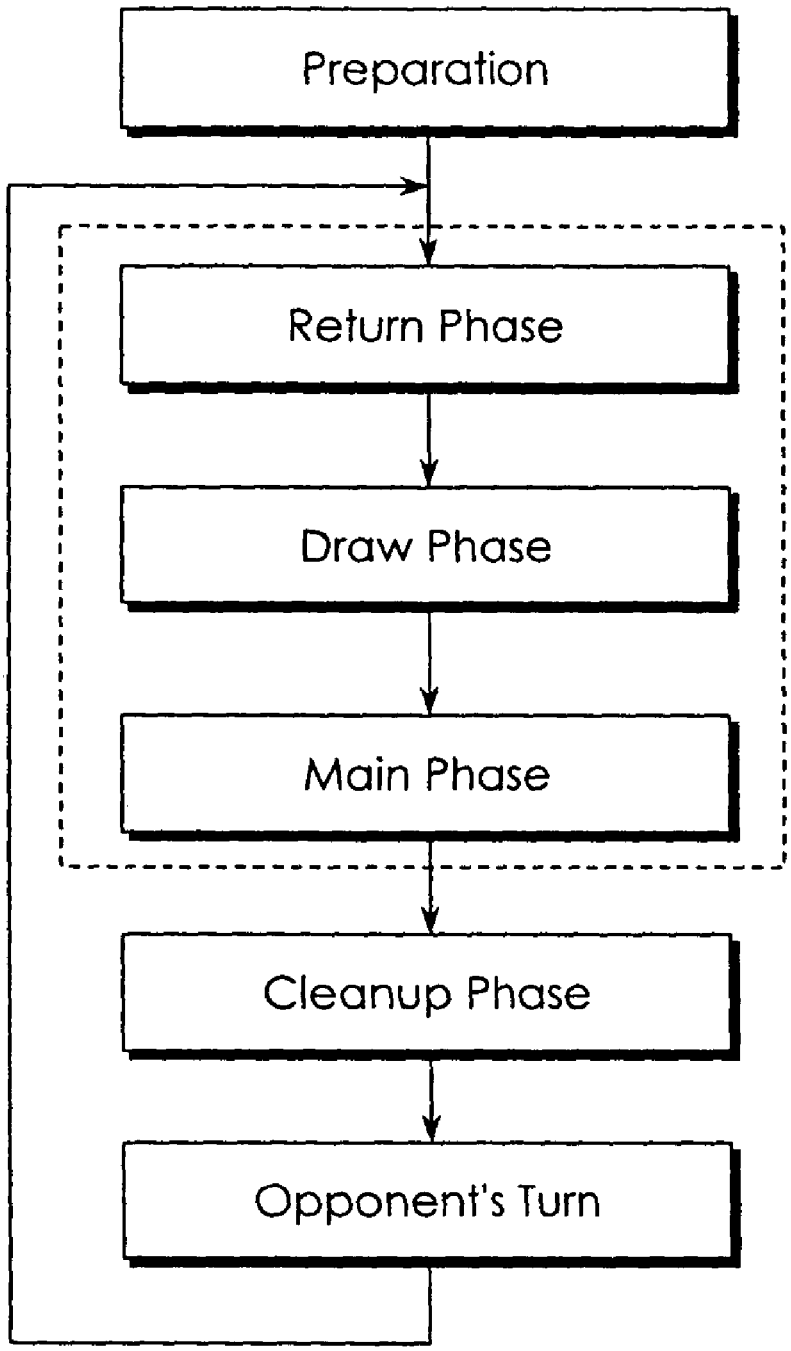
FIG. 5 is a flow chart showing the preparations and development of the game.

A turn is illustrated in FIG. 5.

(1) Return Phase

All turned cards which have been rotated from their original vertical orientations to the horizontal orientations are returned to their original orientations. At the beginning of the game play, this phase is omitted.

(2) Draw Phase

The player draws one card from his or her deck.

(3) Main Phase

In this main phase, the player can play by combining the following four actions at his or her option.

① To place one bomb (cost payment) card B from his or her hand on the play field. If no bomb cards B are included in his or her hand, this action is omitted.

As a principle, the player can place only one bomb card on the play field during one turn. The bomb card B once placed on the play field is available for use every turn of the player. In other words, unless the bomb card is forcibly trashed by means of the effect indicated on the particular card of the opposing player, the bomb cards, which are placed on the play field every turn, are accumulated. The cost payment is flagged by turning the bomb card or rotating the bomb card from its vertical orientation to the horizontal orientation.

② To place a character card on the play field by paying the cost.

Figure 6:
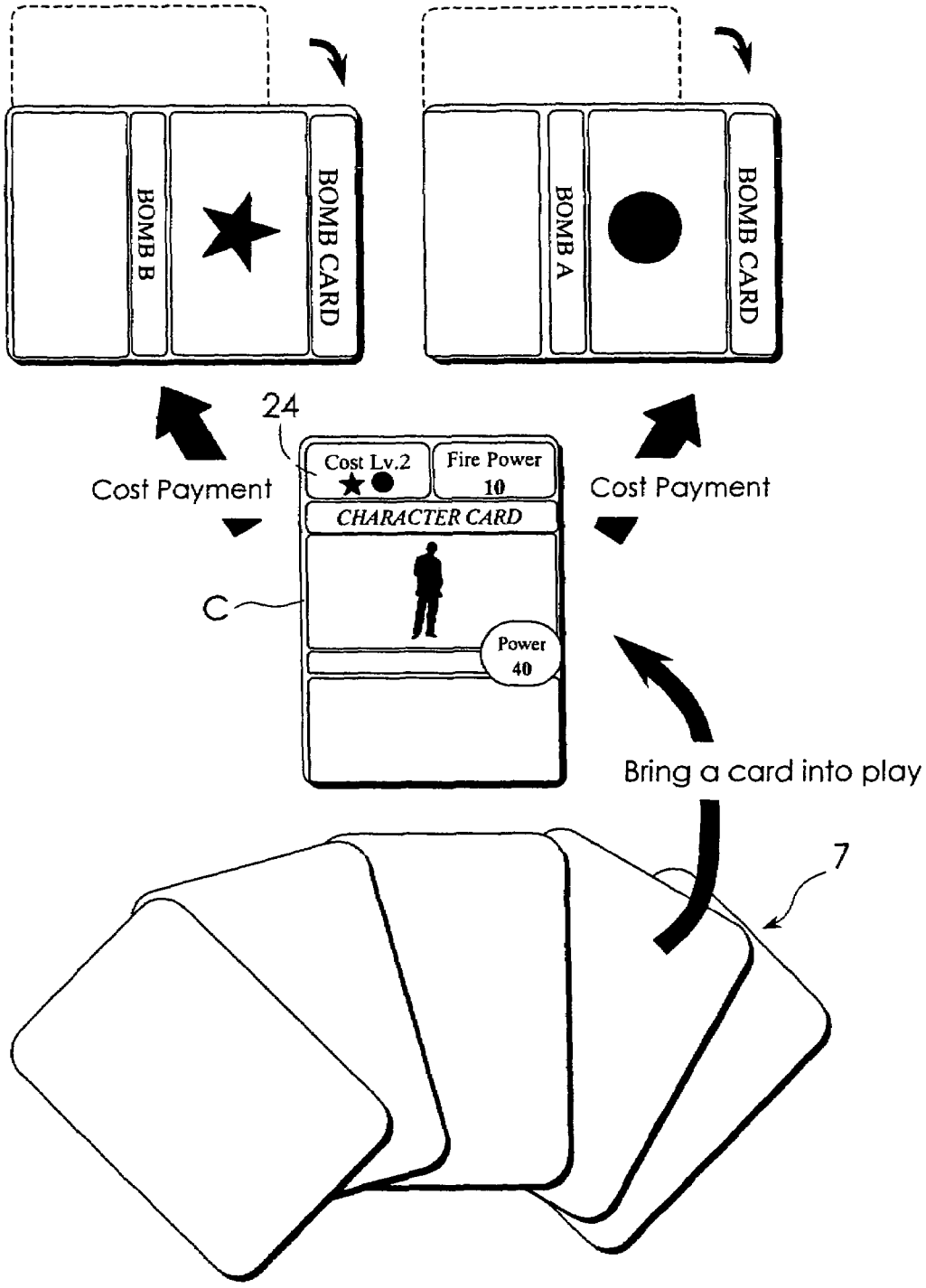
FIG. 6 is an illustration used to describe the procedure of placing a character card on the play field.

As shown in FIG. 6, for example, in order to place the character card C from the player's hand onto the play field, the player must pay the cost by using the bomb card having the same symbol as the one shown in the cost indicator 24 of the character card. The bomb card must be turned to indicate that the card has been used for cost payment.

③ To use the character card in the battle.

The player uses one or more character cards placed on the play field to deliver attack on one or more character cards placed on the play field of the opposing player or the opposing player himself or herself having points. This attack does not require cost payment. Cost payment can be defined as a requirement for this attack.

Figure 7:
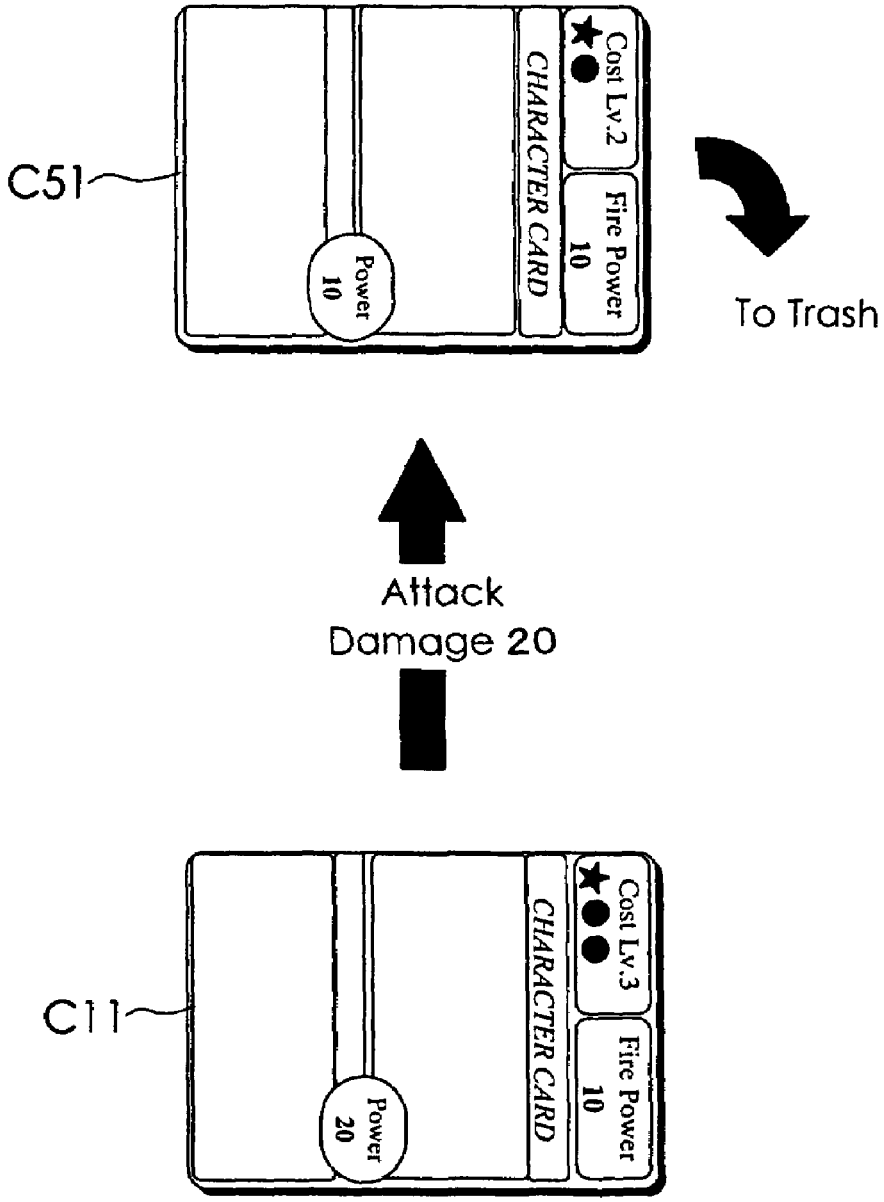
FIG. 7 is an illustration used to describe an example of attack by the character card.
Figure 8:
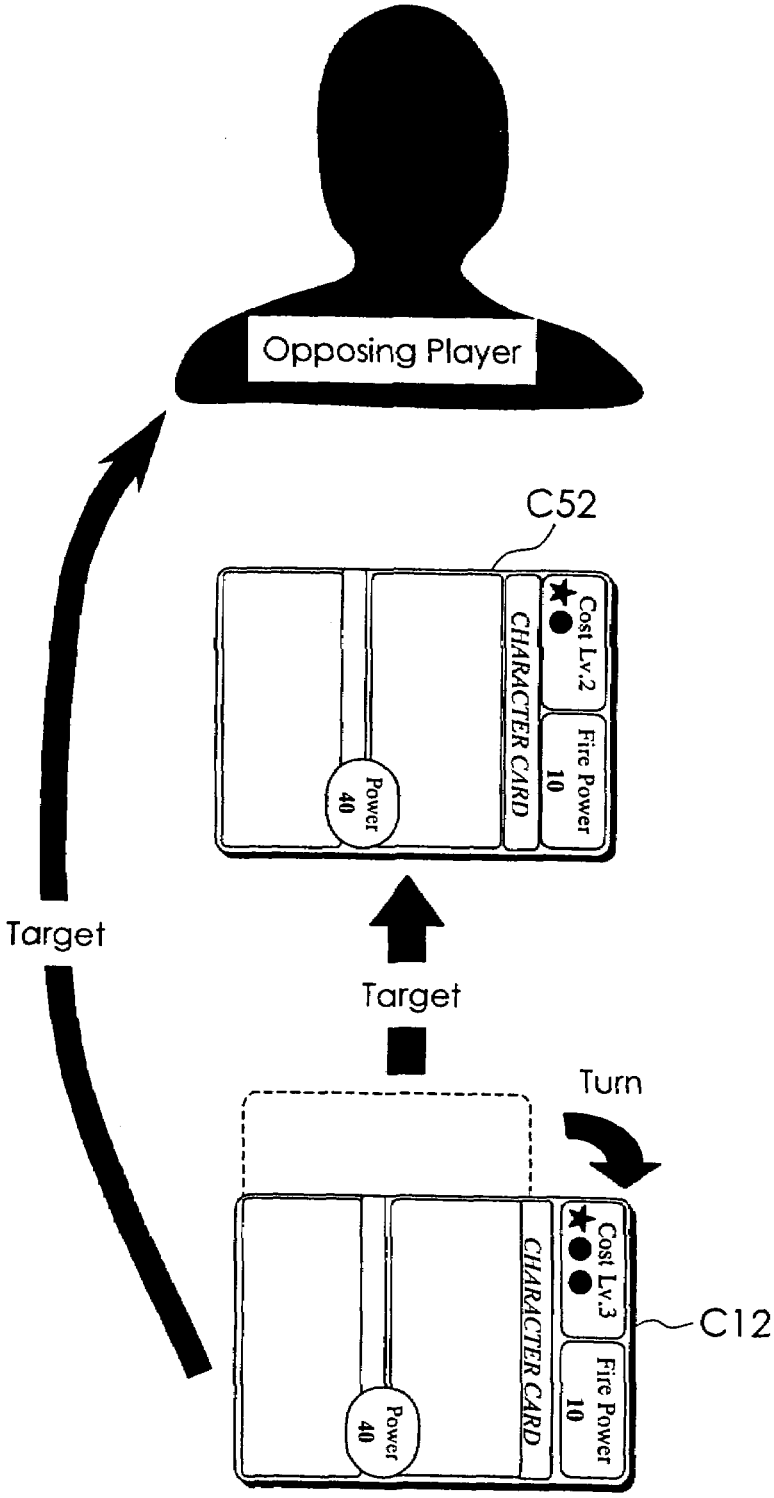
FIG. 8 is an illustration used to describe another example of attack by the character card.

As shown in FIG. 7, the player must turn his or her character card C11 when he or she uses that character card in the attack. In an example shown in FIG. 7, the opposing player's character card C51 has already been turned. This means that the opposing player used the character card C51 in an attack action during his or her turn. With the character card C51 turned as shown in FIG. 7, if the player attacks that card as a target, the character card C51 of the opposing player receives a damage of minus 10 and is discarded to the trash. It is admitted that the player can select the opposing player as a target of attack by the character card. As shown in FIG. 8, when all of the character cards C52 of the opposing player are turned or no character cards are placed on the play field of the opposing player, the opposing player may be selected as a target. The points of the opposing player are reduced by an amount equivalent to the attack power of the character card C12 attacking the opposing player. In an example shown in FIG. 8, when attacked, the opposing player loses 40 points.

Figure 9:
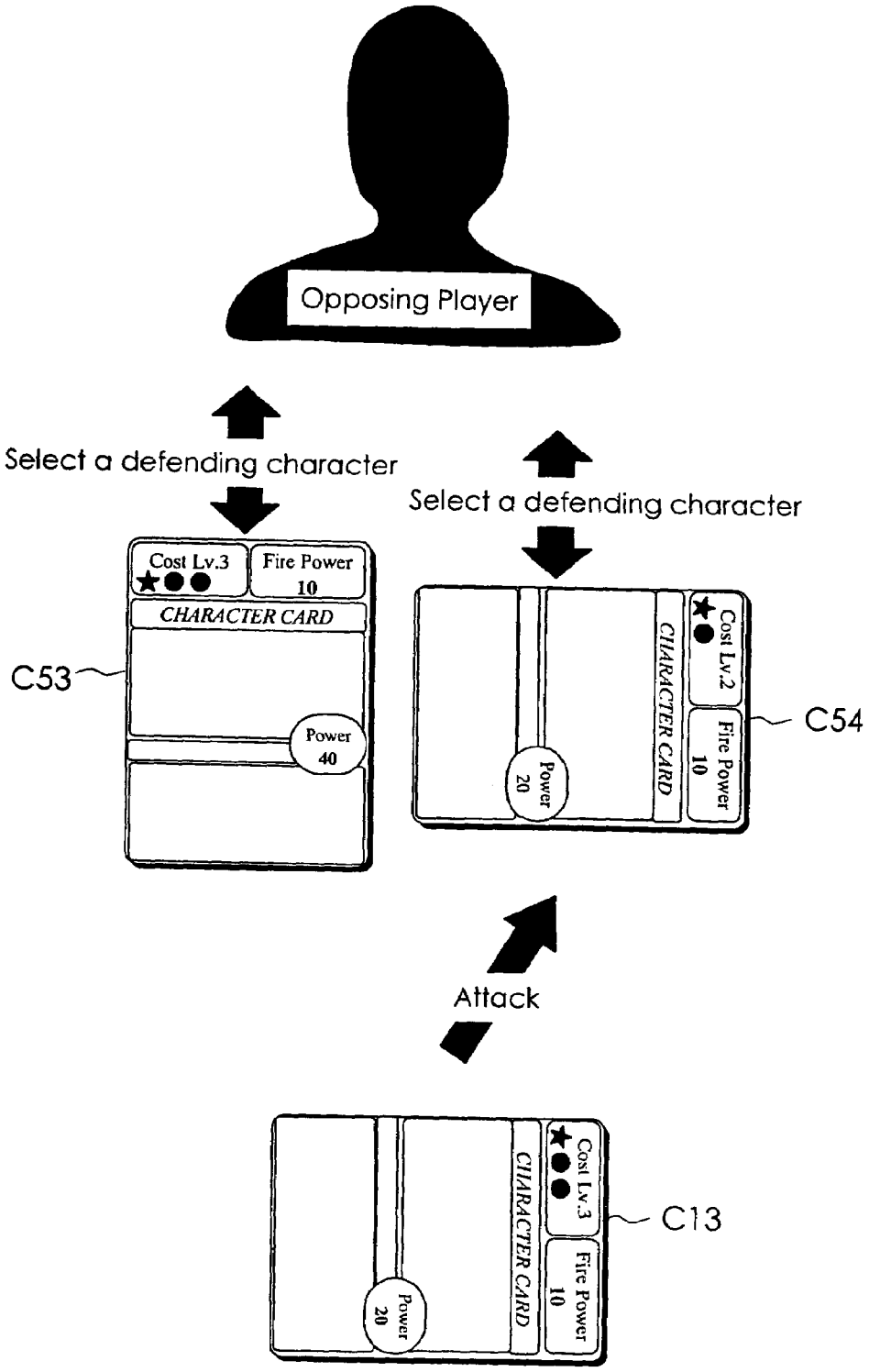
FIG. 9 is an illustration used to describe still another example of attack by the character card.

In this embodiment, however, the decision to select an attack target moves to the opposing player if even one of the character cards C53, C54 placed on the opposing player's play field is returned or vertically oriented, namely the character card C53 is returned as shown in FIG. 9. In other words, the player attempts an attack by turning the character card C13, the opposing player can select to resist the attack by using his or her own points or to use the character card C53 or C54 to defend against the attack. In an example shown in FIG. 9, the opposing player can prevent his or her points from decreasing by defending against the attack using the character card C54 With this rule, the player less often uses a defensive strategy of using the character card to deliver attack on the opposing player without carefully thinking.

Figure 10:
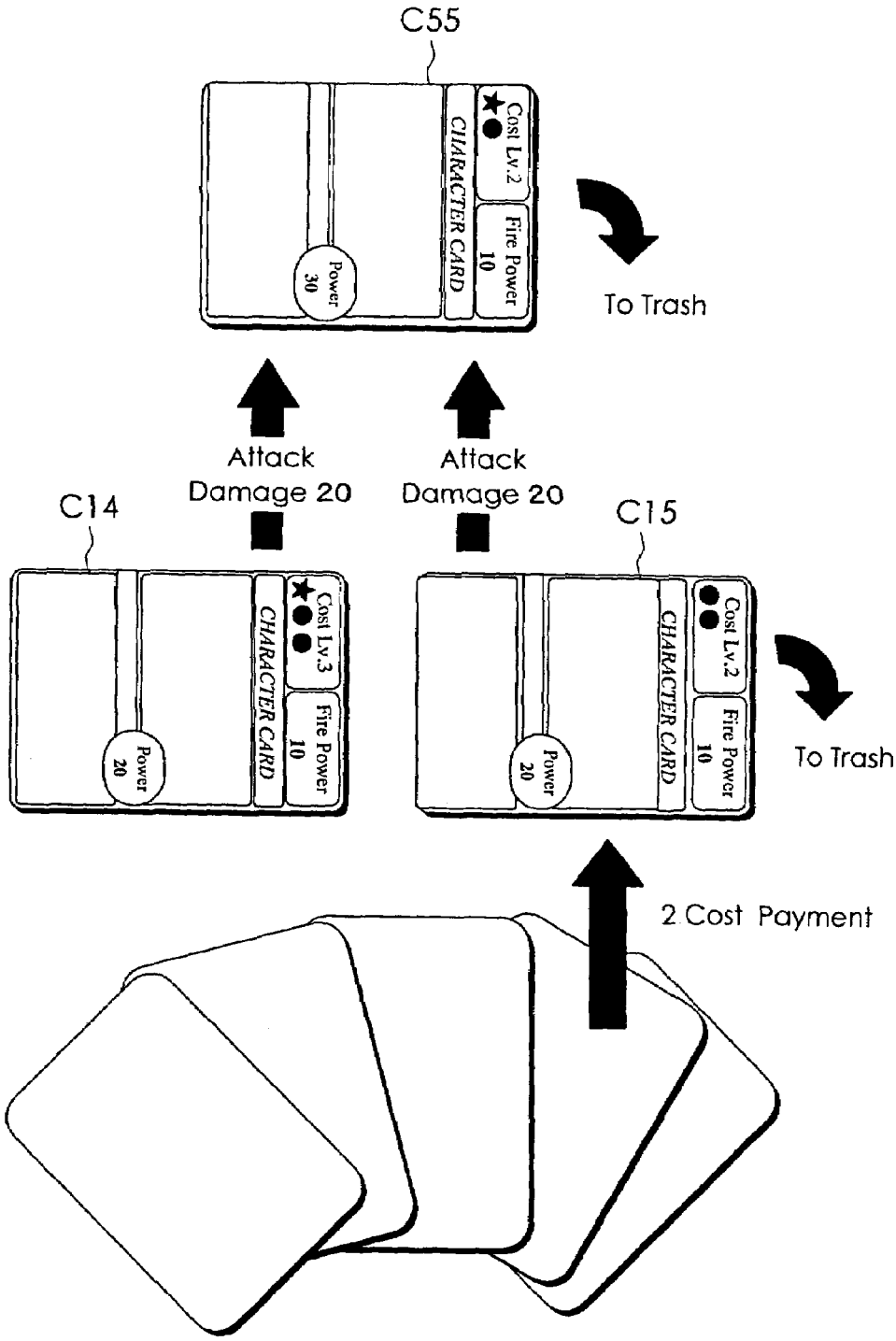
FIG. 10 is an illustration used to describe yet another example of attack by the character card.

As shown in FIG. 10, the player can use two character cards C14 and C15 to attack the character card C55 of the opposing player. In this case, the character card C55 of the opposing player receives a damage of minus 10, thereby being trashed.

The effect indicated on the character card placed on the play field is brought into play when turned.

④ To enable the effect indication card in the player's hand to take effect by paying the cost. The player may bring into play the effect of the effect indication card in his or her hand in an attack action. In order to bring the effect into play, the player must turn a required number of bomb cards B that are equivalent to the cost indicated by the cost indicator 34 of the effect indication card (as shown in FIG. 3).

⑤ To deliver bomb attack.

Bomb attack means that the player draws a card from his or her deck and uses it to deliver attack on a target, provided that the cost payment is fulfilled. The bomb attack comprises the following steps.

(i) Turn one bomb card.

(ii) Select one target.

As a target, the opposing player or one or more returned character cards of the opposing player may be selected.

(iii) Select one or more defense characters.

In this case, the opposing player can choose the character card or himself or herself as a target if one or more returned character cards are placed on his or her play field.

(v) Solve the damage.

The player opens the top card of his or her deck to deliver additional attack on the target.

Figure 11:
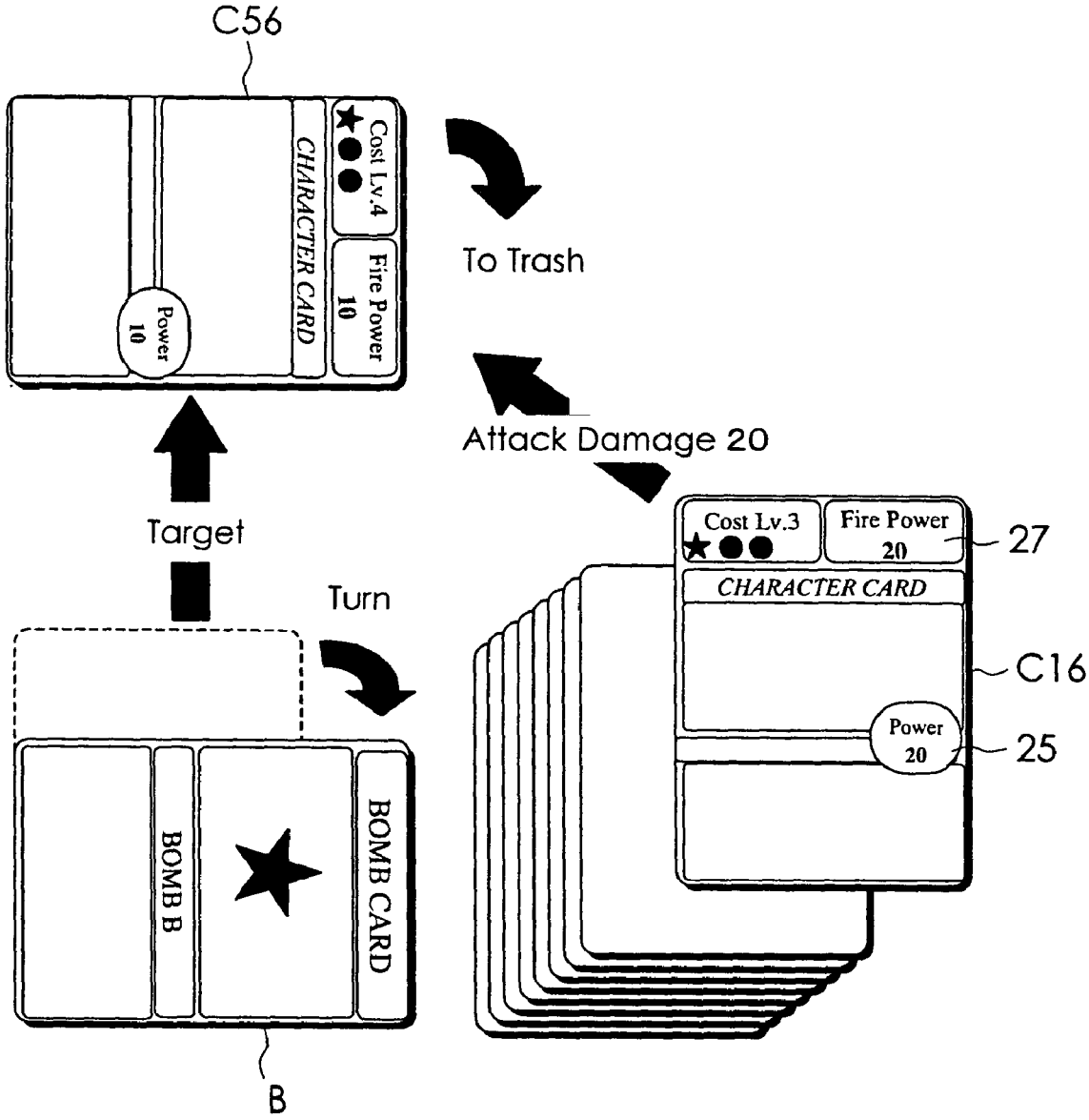
FIG. 11 is an illustration used to describe an example of bomb attack.

For example, in a bomb attack shown in FIG. 11, the additional attack power indicator 27 of the card drawn from the deck is 20. The targeted character card C56 receives a damage of minus 10, thereby being trashed.

Figure 12:
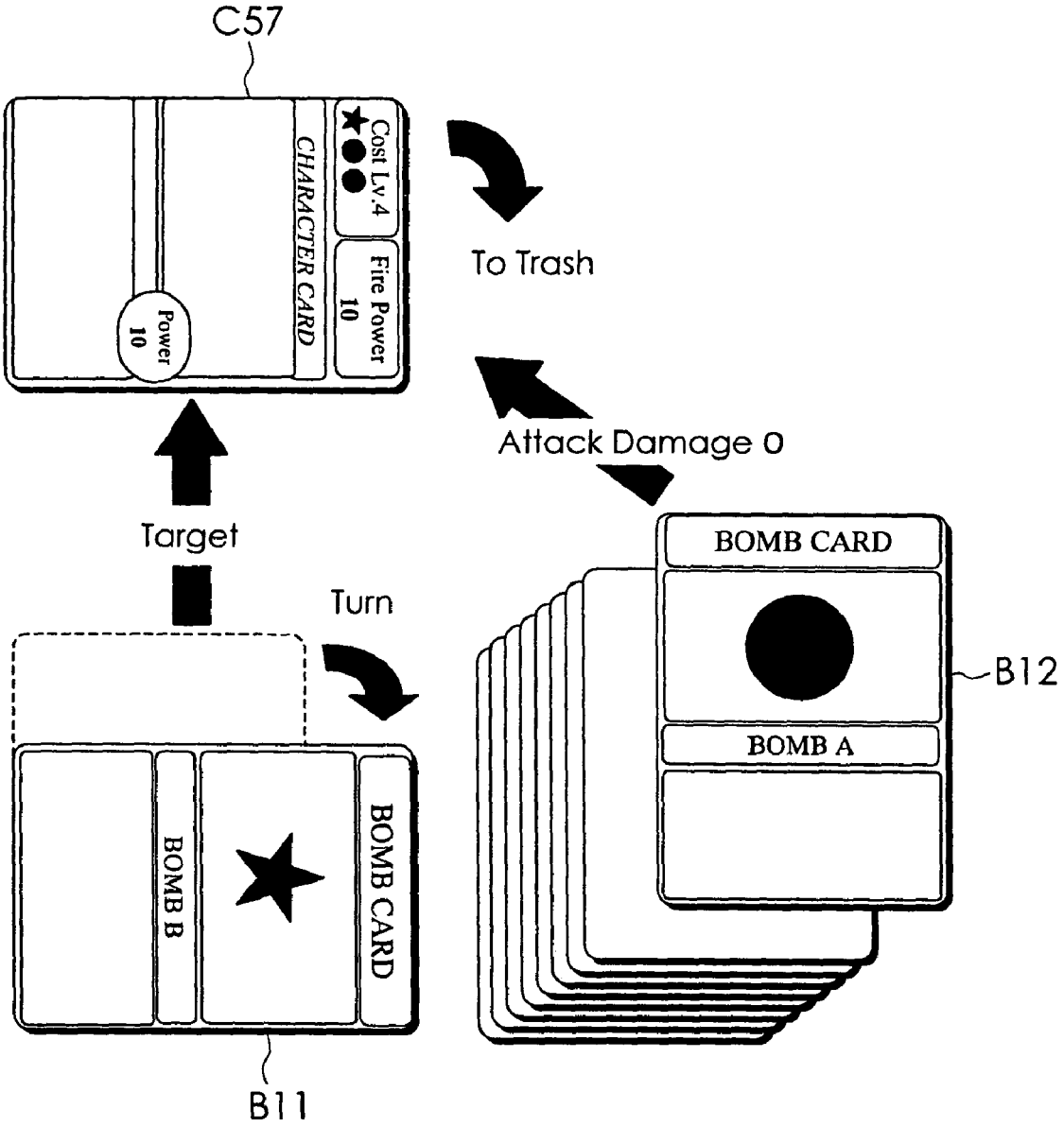
FIG. 12 is an illustration used to describe another example of bomb attack.

In a bomb attack shown in FIG. 12, the card drawn from the deck is a bomb card B12. No additional attack power is obtained. The targeted character card C57 receives zero damage.

Figure 13:
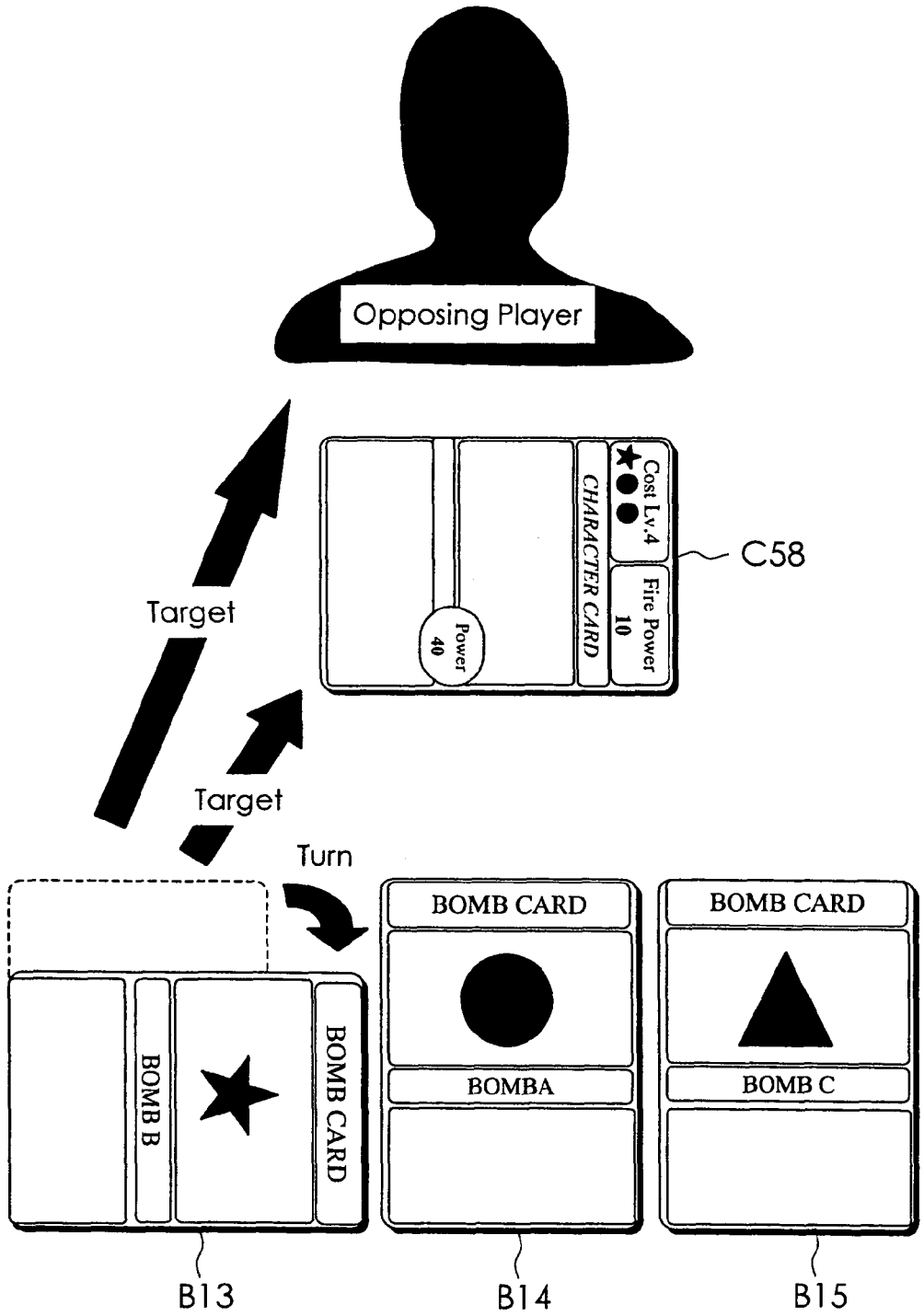
FIG. 13 is an illustration used to describe still another example of bomb attack.

In a bomb attack shown in FIG. 13, since the character card C58 is turned, either one of the opposing player or character card C58 can be selected as a target of bomb attack. In this situation, all of bomb cards B13, B14, B15 can be used in a bomb attack on the opposing player. As the number of bomb cards increases, the game development may sometimes be sharply accelerated.

Figure 14:
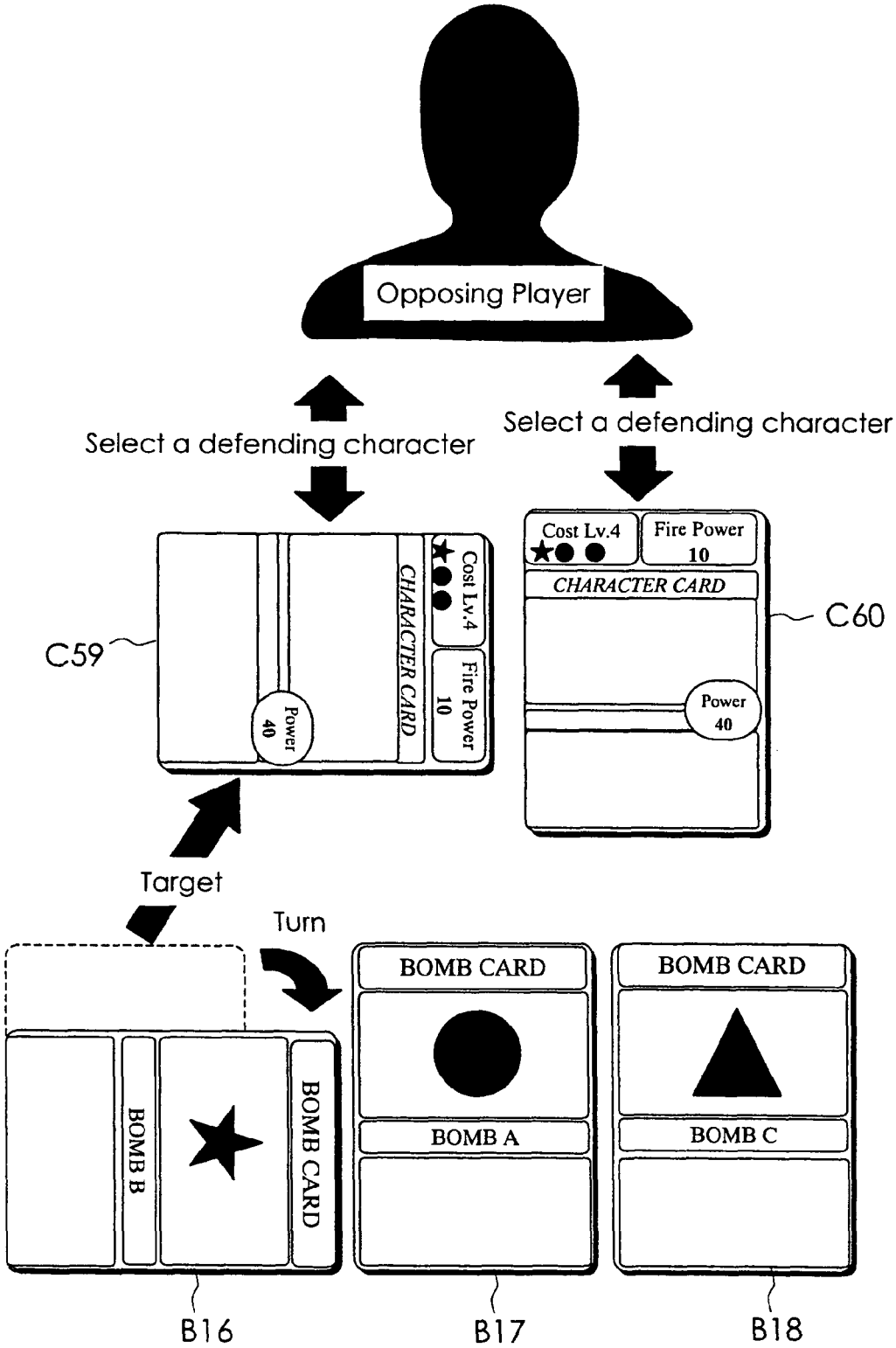
FIG. 14 is an illustration used to describe yet another example of bomb attack.

In a bomb attack shown in FIG. 14, since the character card C60 is returned, the opposing player has the decision to specify or determine the target of bomb attack. Usually, the opposing player specifies as a target the character card C59 having a large defense power.

Needless to say, the bomb attack can jointly be used with the attack by the character card.

⑥ To announce completion of the turn.

The player announces to the opposing player that his or her turn is over when he or she finishes the abovementioned actions.

(4) Cleanup Phase

The player resets the damage of the cards placed on his or her play field to zero when the opposing player's turn is over. Then, the next player's or opposing player's turn is started.

As the games proceeds according to the steps described so far, in case of two players involved in the game, the game is over when the points of either one of the players decreases to zero. In case of three or more players involved in the game, the game may continue until only one player remains.

According to the present invention, the players can play the game by effectively utilizing additional attack power in attack actions against the opposing players. The additional attack power is indicated on one or more battle cards and/or one or more effect indication cards in the player's hand or deck or on the play field. The players can bring the additional attack power into play by paying the required cost using the cost payment cards. In addition to the use of originally intended functionality of the battle and effect indication cards, the additional attack power of those cards can be utilized in the game. Thus, without using the effect indicated on the effect indication card, overall attack power can be increased. Consequently, according to the present invention, the players can get familiar with the game in a comparatively short time without knowing how the effect indicated on the effect card works. In addition, by elaborating a strategy in respect of how much and at what stage additional attack power should be executed in order to increase the overall attack power (attack power plus additional attack power or accumulated additional attack power), the game can be completed in a short time and the players can enjoy the speedy development of the game.

Especially, the additional attack power can be defined for the battle cards independently of the attack power by indicating additional attack power on the cards in addition to the attack power. Therefore, by properly defining the balance of the attack power with the additional attack power, it becomes possible to define how far and how much the influence or effect of the additional attack power extends. According to the age or the level of skill of the players, the balance of the attack power with the additional attack power can be defined. In conclusion, the present invention can readily provide a card game which can be adapted to the players of any age and any level of skill.

Further, the present invention is not limited to this embodiment, but various variations and modifications may be made without departing from the scope of the present invention.

What is claimed is:

1. A method of playing card game for two or more players, comprising the steps of:

providing at least two decks of cards, one for each player;

wherein each of said decks comprises a plurality of cards including a plurality of battle cards having at least attack power and defense power indicated thereon, a plurality of effect indication cards having an effect indicated thereon that is brought into play when used, and a plurality of cost payment cards to be used for cost payment, wherein said plurality of battle cards and/or said plurality of effect indication cards respectively have an indication of additional attack power thereon, each of said cost payment cards have a symbol thereon indicating that each card belongs to one of a plurality of category groups, and said plurality of battle cards have said one or more symbols thereon indicating cost required to place the battle card on a play field, each player having a hand of cards and a deck of cards, each player using said cost payment card to pay cost, and each player drawing said one or more battle cards from said hand of cards and placing them on the play field, each player using said cost payment card to pay cost and drawing one or more cards from said deck of cards, wherein, to pay cost, each player uses said cost payment card having the symbol which is same as one of the one or more symbols on the battle card placed on the play field, and wherein if said one or more cards drawn from said deck of cards are said one or more battle cards and/or effect indication cards, said additional attack power indicated on said one or more cards drawn from said deck of cards is added to said attack power indicated on said one or more battle cards placed on said play field, and a sum value of said attack power and said additional power is used in a battle.

2. The method of playing card game of claim 1, wherein one winning condition for the battle is defined as reducing an opposing player's points down to zero by using said attack power and said additional attack power on an assumption that a predetermined value of points are allocated to each of the players.

3. The method of playing card game of claim 2, wherein the player is allowed to choose to direct said attack power and said additional attack power to said one or more battle cards placed on said play field by the opposing player, or to directly reduce said predetermined value of points of said opposing player, by using said attack power and said additional attack power.

4. The method of playing card game of claim 1, wherein said attack power and said defense power of said plurality of battle cards are indicated with a common symbol.

5. The method of playing card game of claim 1, wherein said cost payment card has a description thereon indicating effect to be brought into play, and said effect is demonstrated, accompanying an execution of said additional attack power by fulfilling said cost payment.

* * * * *